US006058679A

United States Patent [19]

Ziegler et al.

[11] Patent Number: 6,058,679

[45] Date of Patent: May 9, 2000

[54] APPARATUS FOR PACKAGING ARTICLE GROUPS

[75] Inventors: Kelly W. Ziegler, Crosby, Minn.; Dennis C. Grimm, Marietta, Ga.; Jeffrey A. Lashyro, Crosby, Minn.

[73] Assignee: Riverwood International Corporation, Atlanta, Ga.

[21] Appl. No.: 09/010,728

[22] Filed: Jan. 22, 1998

Related U.S. Application Data

[63] Continuation-in-part of application No. 08/586,408, Jan. 16, 1996, Pat. No. 5,727,365.

[51] Int. Cl.[7] ..... B65B 35/30

[52] U.S. Cl. ..... 53/448; 53/447

[58] Field of Search ..... 198/418.1, 418.2, 198/418.3, 431, 432, 433; 53/250, 251, 252, 447, 448, 534, 543, 540, 566

[56] References Cited

U.S. PATENT DOCUMENTS

| | | | |
|---|---|---|---|
| 2,678,151 | 5/1954 | Geisler | 53/543 X |
| 3,513,623 | 5/1970 | Pearson | 53/543 X |
| 3,524,295 | 8/1970 | Spaulding | 53/539 X |
| 3,555,770 | 1/1971 | Rowekamp | 53/251 X |
| 3,645,068 | 2/1972 | Langen | 53/566 |
| 3,660,961 | 5/1972 | Ganz | 53/543 X |
| 3,778,959 | 12/1973 | Langen et al. | 53/534 X |
| 4,642,927 | 2/1987 | Culpepper | 53/543 X |
| 4,802,324 | 2/1989 | Everson . | |
| 4,936,077 | 6/1990 | Langen et al. | 53/543 |
| 4,962,625 | 10/1990 | Johnson et al. | 53/543 X |
| 5,036,644 | 8/1991 | Lashyro et al. . | |
| 5,070,992 | 12/1991 | Bonkowski | 53/543 X |
| 5,241,806 | 9/1993 | Ziegler et al. . | |
| 5,347,796 | 9/1994 | Ziegler et al. | 53/252 X |
| 5,437,143 | 8/1995 | Culpepper et al. | 53/566 X |
| 5,456,058 | 10/1995 | Ziegler | 53/566 X |
| 5,457,940 | 10/1995 | Ziegler et al. | 53/447 |
| 5,469,687 | 11/1995 | Olson | 53/540 X |
| 5,477,655 | 12/1995 | Hawley | 53/543 X |
| 5,546,734 | 8/1996 | Moncrief et al. | 53/543 X |
| 5,630,311 | 5/1997 | Flix | 53/543 |
| 5,638,663 | 6/1997 | Robinson et al. | 53/252 X |
| 5,666,789 | 9/1997 | Ziegler . | |
| 5,755,075 | 5/1998 | Culpepper | 53/540 X |
| 5,765,336 | 6/1998 | Neagle et al. | 53/543 X |

*Primary Examiner*—Daniel B. Moon
*Attorney, Agent, or Firm*—Skinner and Associates

[57] ABSTRACT

A method and apparatus for packaging flat or stacked cylindrical article groups into a packaging unit such as a paperboard carton wherein at least one stream of cylindrical articles are conveyed single file in parallel lanes into a staging area where the lanes terminate, thereby directing the articles into a closest packing formation. Articles are moved in closest packing formation through the staging area over a deadplate toward one of a plurality of containers moving in a generally linear direction parallel to a carton line. An angle of approximately 60° between the staging area and a container in position for receiving articles orients a row of articles in closest packing formation parallel with the open front end of that container. As articles enter the container, each row of articles rolls over the previous row, causing articles to be arranged in a rectangular array in the container. When the container is filled with articles, flow of articles stops and a bar is engaged to clamp a row of articles adjacent to the filled container between the bar and the deadplate. The back of the container is moved away from the articles therein to allow the last row of articles in the full container to pass by articles constrained by the bar without scratching or otherwise damaging the articles when the filled container is moved. The filled container is moved away from the clamped articles, an empty container is moved into position to receive articles, and the bar is disengaged to allow articles to flow into the container. Articles in the container are subsequently loaded into a carton on the carton line.

13 Claims, 5 Drawing Sheets

APPARATUS FOR PACKAGING ARTICLE GROUPS

CROSS-REFERENCE TO RELATED APPLICATIONS

This application is a Continuation in Part of U.S. patent application Ser. No. 08/586,408 filed Jan. 16, 1996, U.S. Pat. No. 5,727,365.

STATEMENT REGARDING FEDERALLY SPONSORED RESEARCH AND DEVELOPMENT

Not Applicable.

BACKGROUND OF THE INVENTION

1. Field of the Invention

This invention relates to packaging methods and apparatus. Particularly, this invention relates to an apparatus and method for packaging flat and stacked groups of articles into carrying cartons. The apparatus and method are particularly well suited for packaging relatively large groups of small articles in stacked configurations into paperboard cartons.

2. Background of the Invention

Prior art packaging machines include U.S. Pat. No. 4,802,254 to applicants' assignee, Riverwood International Corporation, for a Vertical Cartoning Assembly and Method which discloses the assembly of cartons for pre-selected article groups being moved on a conveyor. U.S. Pat. No. 5,036,644, also to applicants' assignee, discloses a Packaging Sleever Assembly which transfers flat packaging sleeves directly onto pre-selected article groups and subsequently wraps and closes the cartons. U.S. Pat. No. 5,241,806, also to applicants' assignee, discloses a Continuous Motion Cartoner Assembly which loads article groups into open ended carton sleeves. Additionally, applicants' assignee manufactures TWIN STACK® Packaging Machines, disclosed in U.S. Pat. No. 5,666,789, which form stacked article groups and subsequently load the groups into open ended carton sleeves.

On the TWIN STACK machines, groups of articles, such as cylindrical beverage cans, are arranged in a rectangular array, such as 3 by 4, and placed in a carton. To accomplish this, cans are fed in mass by a conveyer into a series of lanes separated by walls where the cans are aligned with each other. Each lane is wide enough for a single can with little clearance. Multiple lanes are used to create the width of the array, and a selecting mechanism is used to select the number of cans in the lanes to form the length of the array.

On one machine, the TWIN STACK 100™, cans are maintained laterally aligned with one another across the lanes by a mechanical device which stops the first can in all lanes at a uniform distance. The selecting mechanism is an indexing type which intermittently allows cans to slide out of the lanes onto a deadplate where a group is formed, then the group is moved away for installation into cartons. The conveyor feeding the cans continues to move, thereby creating pressure on each lane of cans and keeping cans tightly stacked in each lane.

Ideally the conveyor feeding the cans can be used to push the cans onto the deadplate and against a stop which properly locates cans for grouping. However, there is friction between the cans and the walls of the lanes, and frictional load on cans may be different for each lane. When the mechanical device holding the first can in all lanes is released to allow cans to flow onto a deadplate, cans in a lane with lower friction may move faster than cans in a lane with higher friction causing the array to be misaligned on the deadplate. If friction is so high that cans in one lane stick when the others move, the group will be a jumble of the wrong number of misaligned cans. Such an occurrence would typically require stopping the machine to correct the problem.

The solution implemented in the Twin Stack 100™ is to use a reciprocating mechanism having a series of stop pins and bars to lead the cans onto the deadplate, group them, and push them into a carton. A first set of pins are driven upward between each lane of cans to stop the movement of cans. Another set of pins are then driven upward between each lane behind a predetermined number of cans to form a group of cans and stop the cans in the infeed lanes from moving when the group of cans is moved. A set of loading pins then moves in behind the group of cans, the first set of pins retracts, and the loading pins move the group of cans forward and into cartons. The first set of pins are then extend again and a staging bar moves into position in front of the cans in the infeed lanes. The second set of pins is retracted and the cans advance forward contacting the bar. The staging bar is then advanced forward, leading the cans to the first set of pins, then the bar is retracted. The staging bar prevents cans in one lane from moving faster than cans in another lane due to frictional differences between lanes lane. The motion of the pins and staging bar must be synchronized with the rest of the packaging machine. This system is relatively complex and may limit the speed at which the packaging machine can run. Applicant's invention provides an apparatus and method for packaging cylindrical articles which is believed to overcome the limitations and shortcomings of the art.

It is an object of this invention to provide an apparatus and method for reliably packaging products in a wide range of flat or stacked group sizes and configurations. Another object of this invention is to provide a packaging apparatus and method which are usable with a variety of package types and sizes, article types and sizes, and group configurations (stacked and unstacked) and sizes. Another object is to provide an apparatus which is low in cost. Another object is to provide an apparatus which is compact. Another object is to provide an apparatus which is optimized for packaging relatively large groups of relatively small articles.

BRIEF SUMMARY OF THE INVENTION

The apparatus of the present invention provides a method and apparatus for packaging articles. The method comprises the steps of supplying a stream of packaging units, for example paperboard cartons; supplying at least one input stream of articles, for example beverage cans, angled with respect to the stream of packaging units; causing the articles in the input stream to nest in closest packing configuration, i.e. a parallelogram-shaped, nested array of articles wherein each successive row of articles is offset from the previous row by approximately half of the width of an article and the perimeter of the array of articles forms a parallelogram; changing direction of articles moving in closest packing configuration so that articles go from closest packing configuration to a rectangular array; forming a flat, single layer article group at a terminal end of the input stream of articles, the article group having a plurality of articles in a predetermined configuration for example a 3×4 group of 12; and substantially perpendicularly loading the article group into a packaging unit in the stream of packaging units. Preferably, a pair of input streams of articles are supplied, a second input stream of articles being activatable for loading a second flat, single layer article group into the packaging unit, on top of the first article group disposed therein, whereby stacked article groups, for example a group of twenty-four, are formed in the packaging unit. In a stacking mode, a divider sheet, for example a paperboard panel, is optionally placed on top of the first article group prior to its being loaded in the packaging unit, and the second article group is slid across the divider sheet.

The packaging apparatus basically comprises a central, longitudinally oriented, linear carton line; a first or low article infeed line; an optional second or high article infeed line; an optional divider sheet feeder; a grouping device; and a loading mechanism. The carton line is disposed longitudinally and extends downstream to an output end. The article infeed lines are oriented at an angle, preferably sixty degrees, to the carton line and preferably approach the same side of the carton line. The infeed lines are staggered longitudinally along the carton line, the high infeed line being disposed downstream with respect to the low line, and at a higher vertical level than the low line.

The grouping device has a plurality of containers having parallel sides, an open front end for receiving articles, and an open back end for discharging articles. The sides have slots which receive an adjustable back rail, which stops articles flowing into the container. The containers are attached to a conveyance device, such as an endless chain, which intermittently moves the containers parallel to and aligned with a plurality of cartons which receive grouped articles from each container. The containers move along the adjustable back rail and receive articles from one or both of the infeed lines.

Each infeed line has a conveyor which feeds articles into the grouping device, outer lane walls and lane separator walls above and adjacent the conveyor, a deadplate between the conveyor and the grouping device, and an overhead line stop which selectively and intermittently stops the flow of articles on the infeed line. Lane separator walls, which form lanes for articles, constrain articles in single lanes on the input end of the infeed conveyor, and terminate in a staggered configuration in a transition area of the infeed conveyor to cause articles to nest into closest packing formation in a single lane formed by the outer lane walls near the output end of the infeed conveyor. The outer lane walls constrain the closest packing formation to a discrete width at the output end of the infeed conveyor and assure that articles stay nested in closest packing formation as they approach the grouping device.

In one embodiment, the single lane in which cans are arranged in closest packing formation is on the infeed conveyor. In another embodiment, it is on a deadplate between the infeed conveyor and a grouping container. In a third embodiment, it is partially on the infeed conveyor and partially on a deadplate. Because the articles are nested, driving articles on one side of the closest packing configuration with the conveyor will move all of the article in the configuration without driven articles flowing past non-driven articles.

The infeed conveyors are oriented at an angle of approximately 60° to the front end of containers of the grouping device. This orients a row of articles in closest packing formation parallel with the front end of containers of the grouping device. The spacing of the parallel sides of the container corresponds with the spacing of outer lane walls at the output end of the conveyor. As articles flow into the container, they change direction and each row of articles rolls over the previous row so that the group of articles in the container is in a rectangular array. The position of the back rail relative to the front end and the spacing of the sides determines the size and shape of the group of articles in the container.

A deadplate is preferably located between the output end of each infeed conveyor and the grouping container into which articles flow. The deadplate preferably bridges any gap between the conveyor and the grouping container and supports articles as they slide over the deadplate into the grouping container. The deadplate also reacts the load imparted by the overhead line stop when it is engaged to clamp a row of articles between it and the dead plate.

The overhead line stop is a bar located above the articles adjacent to the grouping container into which they flow and oriented transverse to the direction articles flow into the grouping container. It selectively engages and disengages with a row of articles to clamp a row of articles adjacent to a grouping container between the deadplate and the overhead line stop. When engaged the overhead line stop prevents the flow of articles into the grouping container. When disengaged, it allows such flow. The overhead line stop may have a resilient surface on the side which interfaces with the articles.

In operation, carton blanks are erected into open ended cartons on the carton line. Articles are mass fed into the input end of the infeed conveyors where they randomly flow into lanes. Because the infeed conveyors run continuously and the articles flow intermittently, articles are packed tightly into the lanes by the motion of the infeed conveyors. The lanes merge and cause articles to nest into closest packing formation in a single lane for each infeed line.

The overhead stop clamps a row of articles adjacent to a grouping container which stops the entire flow of articles. A grouping container is moved into position to receive articles. The overhead line stop is released and articles flow into the grouping container changing orientation from closest packing to rectangular array as they do so. Articles flow until they encounter the back rail at the back of the container, at which time the entire flow of articles stops. The overhead line stop is engaged again to hold the flow of articles, then the back rail is backed slightly away from the articles in the container to allow the last row of articles in the container to clear the row of articles clamped by the overhead line stop when the container is moved. The full container is then moved away from the articles held by the overhead line stop and an empty container is brought into position for the cycle to be repeated.

For stacked packaging, the low infeed line loads a low group into a grouping container. The container moves to a station where a divider sheet is installed over the group of articles, then moves to a station where the high infeed line loads a group of articles into the container to form a stacked article group inside the container. The container then moves to a station beyond the back rail, thereby opening the back of the container, and the group of articles is then pushed into a carton by a pushing device.

In a flat or single tier article group processing mode, the high infeed line and divider sheet are not used. Articles are fed only from the low article input line into the containers, and are subsequently pushed into cartons.

The features, benefits and objects of this invention will become clear to those skilled in the art by reference to the following description, claims and drawings.

DETAILED DESCRIPTION

The methods and apparatus of the present invention are for packaging articles such as beverage cans in a compact operation. The apparatus is adjusted or changed over to provide reliable packaging of articles or products of varying types, and sizes, in a variety of group sizes and configurations, into packages of varying types and sizes. For example, the apparatus is usable to load beverage cans into a variety of single level and two level or tier (stacked) pack combinations, from six to forty-eight cans, into paperboard cartons or carriers. The apparatus and method are particularly well suited for processing relatively large groups of relatively small products as in the case of the stacked, forty eight pack. Packaging is accomplished reliably, under typical industry tolerances for both beverage can and carton construction. Although the embodiments disclosed load beverage can groups into paperboard cartons, its within the purview of this invention to process articles of a variety of types and sizes and containing a variety of products such as liquids, semi-solids and solids, into a variety of packaging media.

Figure 1:
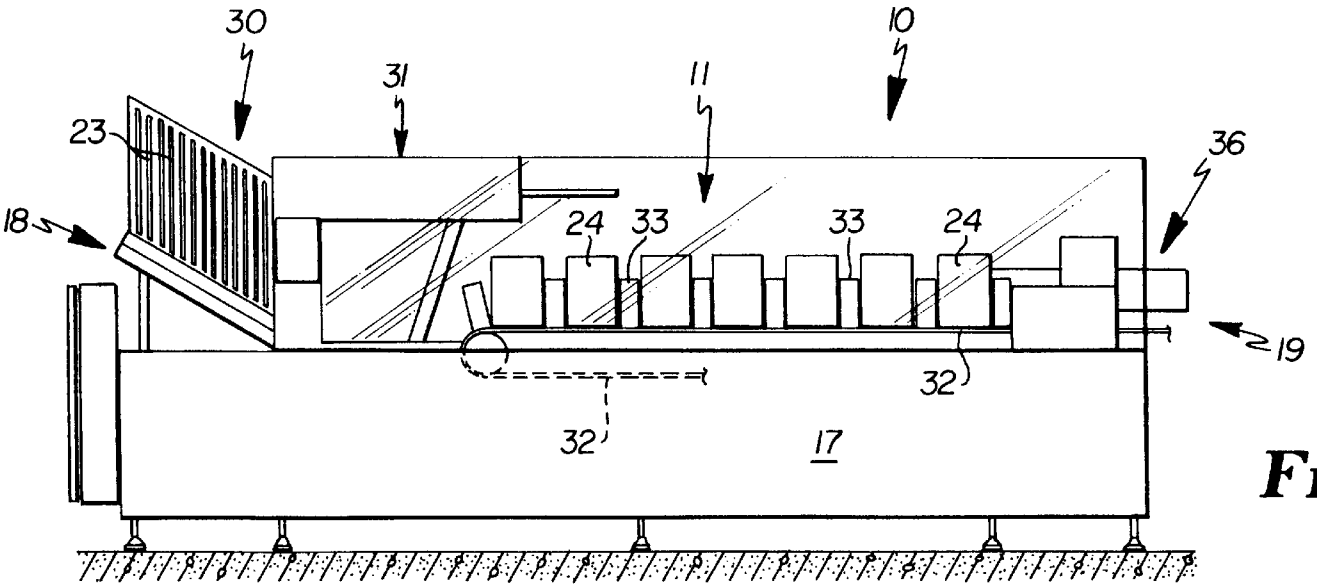
FIG. 1 is a side or elevation view of a packaging machine incorporating the grouping system.
Figure 2:
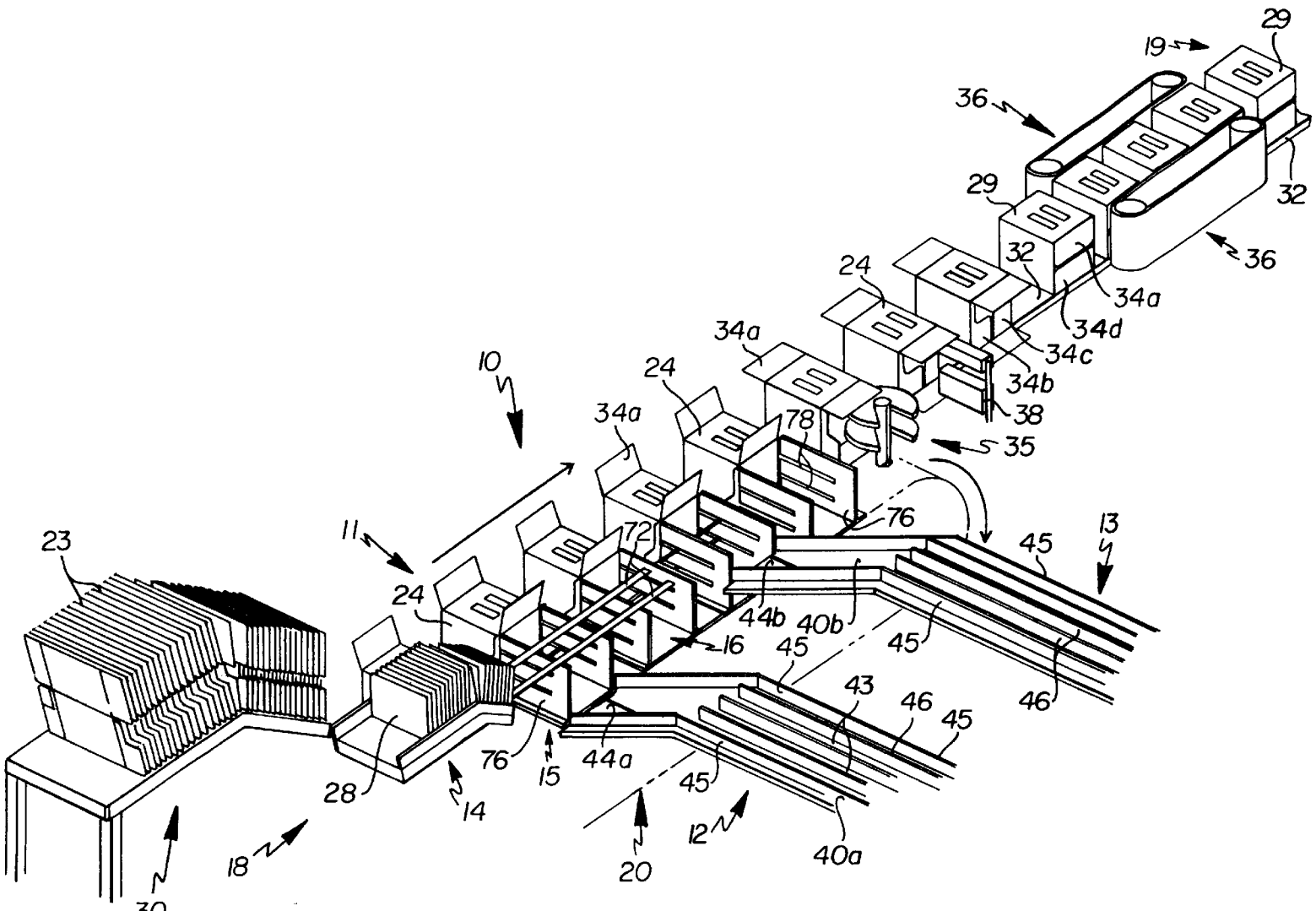
FIG. 2 is perspective view of portions of the apparatus.
Figure 3:
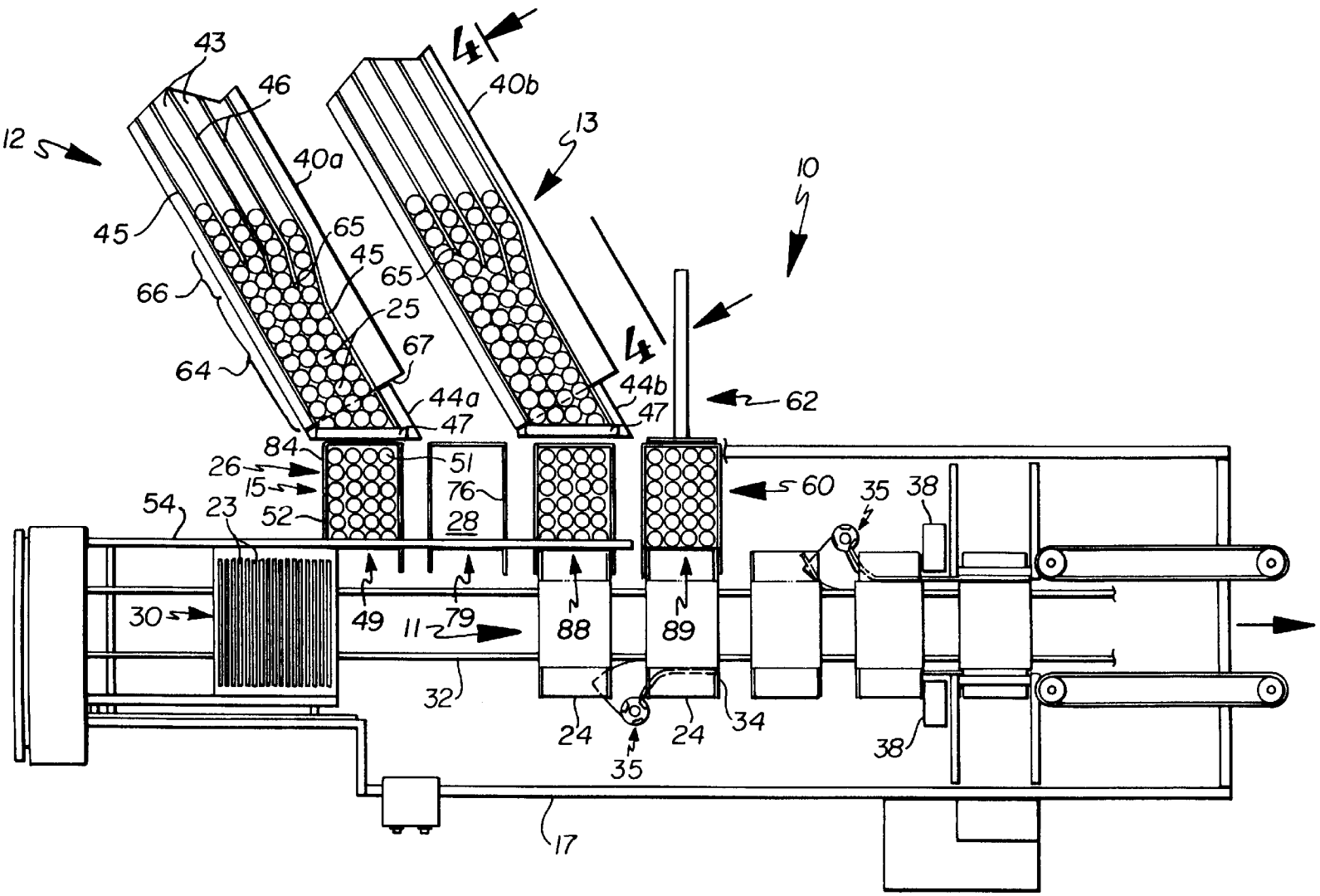
FIG. 3 is a top or plan view of the apparatus.

Referring to FIGS. 1, 2 and 3, a preferred embodiment of the apparatus of the present invention is generally indicated by the reference numeral 10. The packaging apparatus or machine 10 is described below first in terms of its major structural and functional elements and then in terms of its specific structural elements which cooperate to perform a packaging function.

Figure 4:
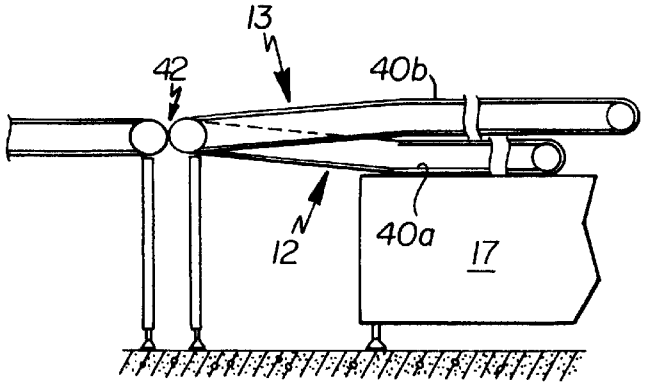
FIG. 4 is a side view of the article input section of the apparatus, taken along line 4—4 of FIG. 3.

Referring also to FIG. 4, the packaging apparatus 10 basically comprises a central, longitudinally oriented, linear carton stream or line 11, a first or low article supply stream or line 12, a second or high article supply stream or line 13, a divider sheet feeder 14, and a grouping container line 15. These mechanisms are preferably supported by a unitary frame structure 17. The carton line 11, article supply lines 12 and 13 and grouping container line 15 are preferably synchronized conveyor-based mechanisms. The carton line 11 is disposed longitudinally and extends from an upstream end 18 to a downstream, output end 19. The grouping container line 15 having a plurality of grouping containers 16 attached to conveyor 20 is parallel to the carton line 11 and disposed between carton line 11 and article supply lines 12 and 13. The article supply lines 12 and 13 are preferably oriented, as shown in FIG. 3, at an angle of sixty degrees to the grouping container line 15. Article supply lines 12 and 13 may alternatively be oriented substantially normal to grouping container line 15, as shown in FIG. 2, provided a terminal portion of the article supply lines 12 and 13 is oriented at sixty degrees to the grouping container line 15. The article supply lines 12 and 13 preferably approach grouping container line 15 from the same side of it and are staggered longitudinally along it, the high line 13 being disposed downstream with respect to the low line 12. Additionally, the article supply lines 12 and 13 are disposed in vertically separate planes, the high line 13 being disposed at a higher level.

In a stacked or double tier article processing mode, both the low line 12 and the high line 13 are operational. Articles 25 on the article supply lines 12 and 13 are mass fed into the input end 42 of the infeed conveyors 40*a* and 40*b* where they randomly flow into lanes 43 formed by outer walls 45 and lane dividers 46. Because the infeed conveyors 40 run continuously and the articles 25 flow intermittently, articles 25 are packed tightly into the lanes 43 by the motion of the infeed conveyors 40. The lanes 43 merge and cause articles 25 to nest into closest packing formation in a single lane formed by outer walls 45 for each article supply line 12 and 13.

Figure 5:
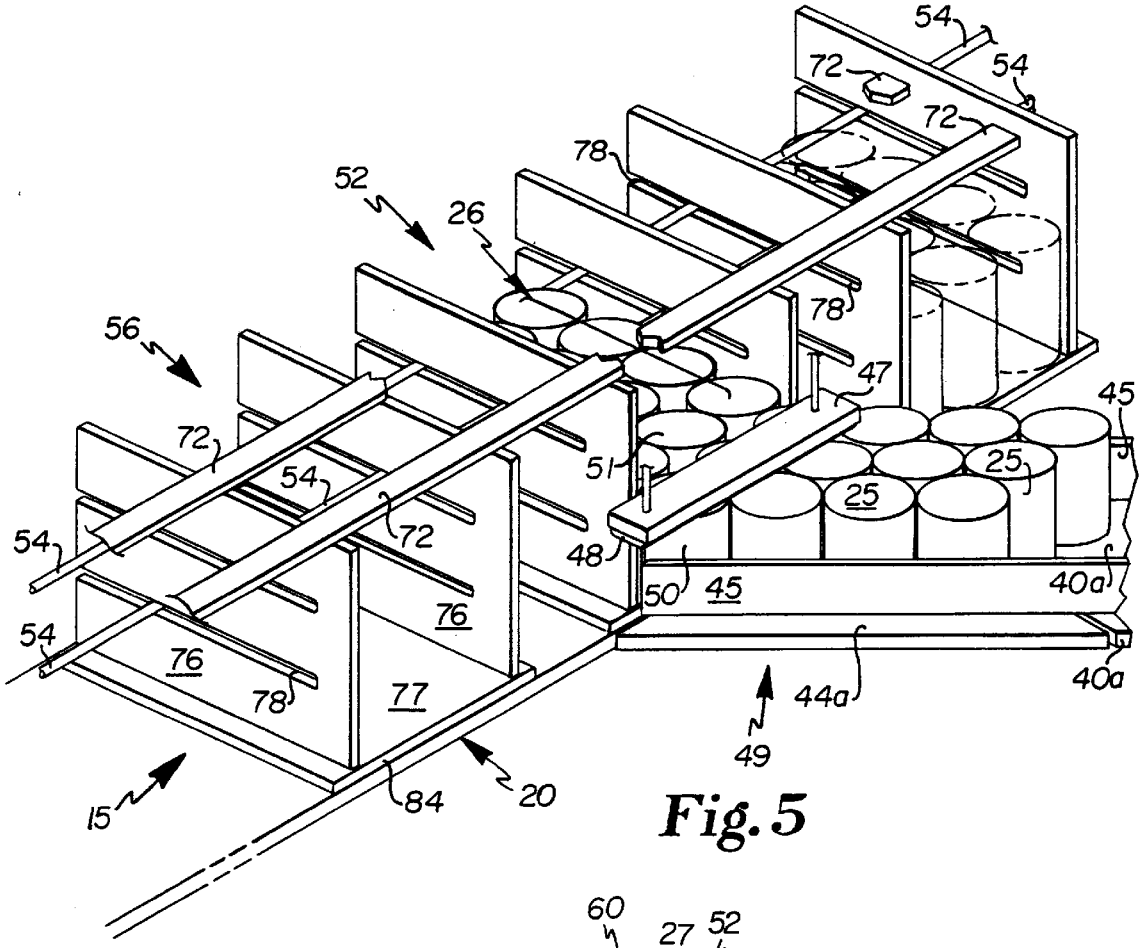
FIG. 5 is a perspective view of a portion of the apparatus showing a lower group of articles being loaded from an article supply line into a grouping, container.

Referring to FIGS. 3 and 5, deadplates 44*a* and 44*b* are aligned with and extend from the terminal ends 67 of the conveyors 40*a* and 40*b* respectively to the grouping container line 15. Deadplate 44*a* is disposed at the level of the top run surface of conveyor 40*a*, and deadplate 44*b* is disposed at the level of the top run surface of conveyor 40*b*. Both deadplates are preferably constructed of a polymeric material such as Nylon. Outer walls 45 of article supply lines 12 and 13 extend over deadplates 44*a* and 44*b* respectively.

An overhead line stop 47 is a vertically movable bar disposed above articles 25 which clamps down across the leading row 50 of articles 25 on deadplate 44*a* adjacent to a grouping container 52 to stop the entire mass of articles 25 from flowing. Overhead line stop 47 preferably has a resilient surface 48 which interfaces with articles 25. A grouping container 52 is moved into position to receive articles 25. The overhead line stop 47 is released and articles 25 flow into the grouping container 52 changing orientation from closest packing to rectangular array as they do so. Articles 25 flow until a back stop, which is preferably a rail 54 movable in slot 78, at the back of the container 52 is encountered, at which time the entire flow of articles 25 stops. Container 52 now holds a lower subgroup 26 of articles 25. The overhead line stop 47 is engaged again to hold the flow of articles 25, then the back rail 54 is backed slightly away from the articles 26 in the container 52 to allow the last row 51 of articles 26 in the container 52 to clear the row 50 of articles 25 clamped by the overhead line stop 47 when the container 52 is moved. The container 52 with lower article subgroup 26 is then moved away from the row 50 of articles held by the overhead line stop 47 and an empty container 56 is brought into position for the cycle to be repeated.

For stacked packaging, the low article supply line 12 loads a low article sub-group 26 into a grouping container 52 at lower article loading station 49. The container 52 then moves to a divider sheet station 79 between the two article supply lines 12 and 13 where, preferably, a divider sheet 28 is deposited onto the top of the low article sub-group 26 by the divider sheet feeder 14. The container 52 then moves to a upper article loading station 88 where the high article supply line 13 slides a high article sub-group 27 over the low article sub-group 26 resident in the container 52 to form a stacked article group 60 inside the container 52. The divider sheet 28 provides a smooth, flat surface which facilitates sliding movement of the high group 27 over the low group 26.

Figure 6:
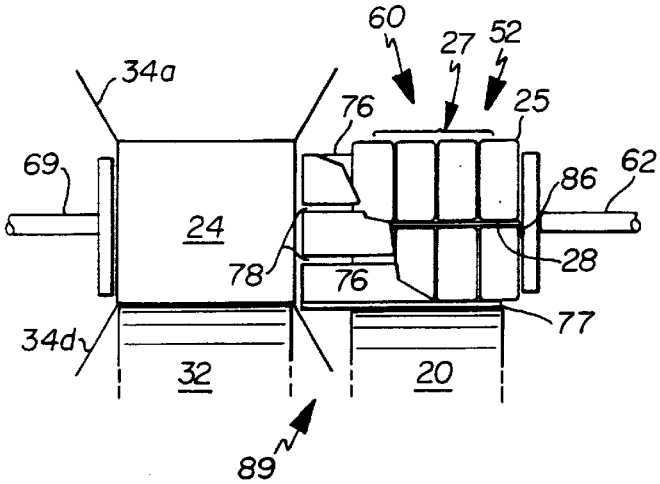
FIG. 6 is a side view of a portion of the apparatus showing a stacked group of articles being loaded from a grouping container into an open carton.

Referring also to FIG. 6, the container 52 then moves to a carton loading station 89 beyond back rail 54, thereby opening the back of the container. A loading apparatus 62 then pushes the stacked group of articles 60 in container 52 into an open carton 24 erected from carton blanks 23 on carton line 11. Carton 24 then advances to have flaps 34 closed.

In a flat or single tier article group processing mode, the high article supply line 13 and divider sheet feeder 14 are not used. Articles 25 are fed only from the low article supply line 12 into the containers 16, and are subsequently pushed into cartons 24 on the carton line 11. In both stacked and flat processing modes, the loaded cartons 24 are transported downstream on the carton line 11 for further processing and output as a filled, completed carton 29.

Referring to FIGS. 1 and 2, the carton line 11 preferably comprises a carton blank magazine 30, a blank placement mechanism 31, and a carton conveyor 32. The upstream end of the conveyor 32 is disposed generally below the blank placer 31. The blank placer 31, for example a reciprocating or rotary placer, picks carton blanks 23 from the magazine 30 and places them on the conveyor 32. The conveyor 32 has a plurality of spaced lugs or flights 33 between which the erected cartons 24 are disposed. The cartons 24 are arranged so that their ends are disposed laterally or to the side with respect to the longitudinal axis of the carton line 11. The cartons 24 have open flaps 34 *a–d* at each side. The conveyor 32 transports cartons 24 linearly, downstream past the article supply lines 12 and 13, flap closers 35, gluers 38, a compression section 36, and to the output end 19 of the machine 10. Flap closers 35 and gluers 38 operate to glue and close the flaps 34 of the cartons 24-once the article group or groups are fully loaded therein, and compression section 36 holds the flaps closed for a sufficient time to allow the glue to set and hold the flaps 34 closed.

Referring to FIGS. 2 and 3, the article supply lines 12 and 13 each transport a plurality of unmetered articles 25 toward an open grouping container 16. The lines 12 and 13 are oriented in a spatially parallel orientation with respect to each other, in separate vertical planes, and on the same side of the grouping container line 15. The lines 12 and 13 preferably approach the grouping container line 15 at a sixty degree angle which facilitates articles 25 in closest packing arrangement in area 64 of lines 12 and 13 being properly aligned with grouping containers 16. The low line 12 is disposed at the level of a top, downstream run of grouping container line conveyor 20, while the high line 13 is disposed immediately above the low line 12. Each line 12 and 13 includes a conveyor 40*a,b*, with outer walls 45 and one or more lane dividers 46 which form lanes 43 and orient the infed articles 25 into linear rows. The lane dividers 46 have portions 65 which terminate at predetermined points staggered along conveyor 40 in transition area 66 which direct articles 25 from separate lanes 43 into their closest packing arrangement. No holes are present in any lanes by the time articles 25 reach transition area 66. The distance between outer walls 45 narrows through transition area 66 to a width in area 64 which constrains articles 25 in their closest packing arrangement in area 64.

Conveyor 40 has a terminal end 67 located near container 52, but not so close so as to drive articles 50 held by overhead line stop 47. Since conveyor 40 is oriented at an angle to container 52, terminal end 67 is also at an angle to container 52, which necessitates using a generally triangular shaped deadplate 44 between conveyor 40 and container 52 to support articles 25 as they slide over deadplate 44 into container 52.

Referring also to FIG. 5, grouping container line 15 has containers 16 on a conveyor 20 parallel to and synchronized with carton line 11. Containers 16 have vertical walls 76 with slots 78 at the rear and an open front 84. Walls 76 are laterally adjustable along base 77 to change the width of containers 16 to thereby change the number of columns of articles 25 which can flow into containers 16. In the example illustrated, walls 76 are positioned to allow four columns of articles into the containers 16. Slots 78 receive movable back rail 54, which is mounted on frame 17. As containers 16 advance along grouping container line 15, slots 78 of walls 76 slide along rail 54. Back rail 54 is positionable front to back so as to determine the number of rows of articles 25 allowed into containers 16. In the example illustrated in FIG. 3, back rail 54 is positioned to allow six rows of articles into the containers 16. As back rail 54 is indexed toward the front of containers 16, the number of rows allowed into each container decreases. The position of back rail 54 along with the position of container walls 76, the width of outer walls 45 and the number of lanes 43 used determine the size and shape of a subgroup 26 or 27 of articles in a container 16. It is within the purview of this invention that the packaging machine may be modified so that articles are input directly into cartons instead of being staged first.

In operation, article supply conveyor 40 preferably runs continuously (but may be indexed), feeding articles 25 onto deadplate 44. When overhead line stop 47 is clamped down on articles 25, the flow of articles is stopped, but the continuous motion of supply conveyor 40 keeps pressure on articles 25 as they slide over the surface of conveyor 40. This pressure keeps articles 25 tightly packed on deadplate 44 and in areas 64 and 66 of conveyor 40. When overhead line stop 47 is released, the pressure from conveyor 40 pushes articles 25 along deadplate 44 and into container 52. Containers 16 are oriented normal to carton line 11, but at a sixty degree angle relative to flow of articles 25 from article supply lines 12 and 13. As articles 25 flow into the front 84 of a container 52, a row of articles changes direction to flow into container 52. In so doing, each row of articles rolls over the previous row so that articles are arranged in a rectangular array in container 52 rather than in a closest packing arrangement as in area 64 of conveyor 40. Articles flow into container 52 until they contact back rail 54, at which time the flow of articles 25 stops. Container 52 now holds a lower subgroup 26 of articles 25. Overhead line stop 47 is then clamped down to hold the pressure of articles 25 being pushed by conveyor 40. Back rail 54 is then backed away from articles 26 some amount to allow the last row 51 of articles 26 in container 52 to slide past the row 50 of articles 25 clamped by overhead line stop 47 without scratching or otherwise damaging articles in rows 50 or 51. The amount that back rail 54 must move depends on the radius of articles 25. For articles such as standard size 12-ounce beverage cans, it is preferably approximately 1/4 inch. Carton line 11 and the grouping container line 15 are indexed forward to move container 52 with lower article subgroup 26 to divider sheet station 79 and bring another container 16 in line with deadplate 44, and the process is repeated.

Referring to FIGS. 2 and 3, The divider sheet feeder 14 is disposed adjacent the low article supply line 12 and the grouping container line 15. The divider sheet feeder 14 preferably is a friction sheet feeder of the type manufactured by Stream Feeder, for example. Sheets 28 are disposed in a magazine portion 30 of the feeder 14 and each sheet 28 is output from the feeder 14 horizontally and from the side onto a plurality of extendible and retractable rods 72 which hold sheets 28 The rods 72 are subsequently retracted resulting in an individual sheet 28 being dropped onto the top surface of the low article group 26. Sheet feeding and dropping preferably occurs after a group 26 has been loaded into container 52 and container 52 has advanced to divider sheet station 79.

Referring also to FIG. 6, the divider sheet 28 has a trailing edge 86 which extends beyond the trailing edge of the low article group 26. The trailing edge 86 is bent at least partially down by deadplate 44*b* on upper article supply line 13 as the grouping container 52 is indexed from the divider sheet placement station 79 to the upper article loading station 88 to provide smooth transfer surface for the high article group 27 flowing into container 52. The loading apparatus 62 may have a recess which receives the trailing edge of divider sheet 28 so it is not crushed during transfer of the stacked group 60 from container 52 to open carton 24. The extended trailing edge of the divider sheet 28 is subsequently folded down by a downstream plow apparatus. Alternatively, if the trailing edges has been sufficiently folded by the upper deadplate 44*b*, loading apparatus 62 may not have a recess and the loading operation may complete the folding of the trailing edge 86 of divider sheet 28.

After a divider sheet 28 has been placed on lower subgroup 26, carton line 11 and the grouping container line 15 are indexed forward to move container 52 to upper article loading station 88. Articles 25 from upper article supply line 13 are slid over divider sheet 28 into container 52 in the same manner as articles 25 were fed from lower article supply line 12. container 52 now has a stacked group 60 of articles 25. Carton line 11 and the grouping container line 15 are indexed forward to move container 52 beyond back rail 54 to a carton loading station 89.

Container 52 is aligned with an open carton 24, and extends to the carton line conveyor 32. A group of articles in container 52 and be slid from container 52 directly into a carton 24.

Operation of the carton line 11, grouping container line 15, overhead line stops 47, back rail 54, loading apparatus 62 and hold back mechanism 69 are all synchronized together and move intermittently while conveyors 40*a* and 40*b* move continuously.

In summary, in a stacking article group processing mode, the low article group 26 is formed by articles flowing into an open container 52 on grouping container line 15. The container 52 moves downstream where a divider sheet 28 from the divider sheet feeder 14 is optionally deposited on the top of the formed low article group 26. The container 52 again moves down stream where the high article group 27 is slidingly moved across the divider sheet 28 to form the stacked article group 60 inside the container 52. The container 52 moves downstream again where the back of it is open and aligned with an open carton 24. A loading apparatus 62 pushes the stacked article group 60 out of container 52 and into carton 24. The filled cartons 24 are subsequently conveyed further downstream for ancillary processes. In a flat or single tier article processing mode, the divider sheet station 79 and upper article loading station 88 are disabled. Only low article groups 26 are inserted into flat cartons of any one of several well known designs (not shown), which are then transported downstream on the conveyor line 11 for gluing, flap tucking, compression and output.

Figure 7:
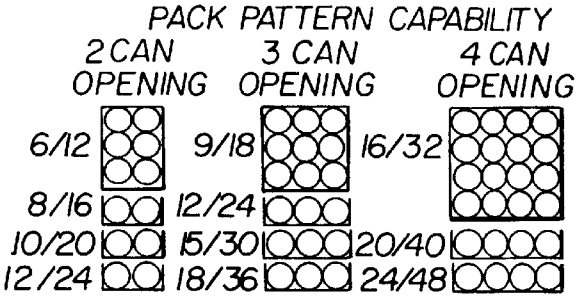
FIG. 7 is a chart showing various exemplary pack patterns provided by the apparatus for a particular can diameter.

FIG. 7 shows various pack patterns that may be formed by the apparatus 10 for beverage cans with a diameter in the range between 2.09 and 2.60 inches (53 and 66 mm.) and height between 3.0 and 7.0 inches (76.2 and 177.8 mm.). The pack patterns include two tier, stacked groups, as well as single tier of flat groups. Additional pack patterns may be achieved utilizing the apparatus and method of this invention depending upon the diameters of the articles. The apparatus 10 is fully adjustable to accommodate various article sizes, group configurations, and carton sizes and configurations.

Figure 8:
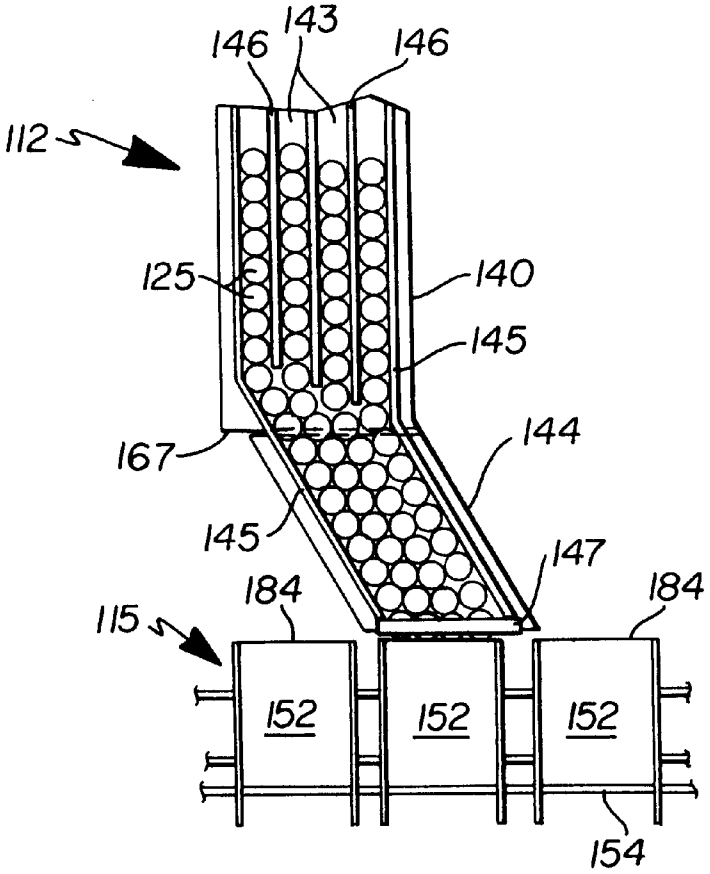
FIG. 8 is a plan view of one alternate embodiment of an article supply line.

Referring to FIG. 8, one alternate embodiment of the invention for a supply line 112 has conveyor 140 oriented normal to the flow of the grouping container line 115 and offset laterally from the front 184 of container 152. Terminal end 167 of conveyor 140 is located a substantial distance from container 152. Deadplate 144 having a parallelogram shape is located between terminal end 167 of conveyor 140 and container 152. Lane divider walls 146 have ends staggered with respect to terminal end 167 of conveyor 140 to direct articles 125 into closest packing arrangement on deadplate 144. Outer walls 145 constrain articles 125 in that configuration on deadplate 144. Because the articles are in a closest packing configuration on deadplate 144, articles slide uniformly across deadplate 144 into container 152 when pushed by pressure from articles on conveyor 140. Deadplate 144 may by any suitable material with a smooth surface and relatively low friction. A polymeric material, such as Nylon, or a metallic plate such as stainless steel or aluminum will work. Overhead line stop 147 and back rail 154 are identical to and function the same as their corresponding components shown in FIGS. 2 and 3.

Figure 9:
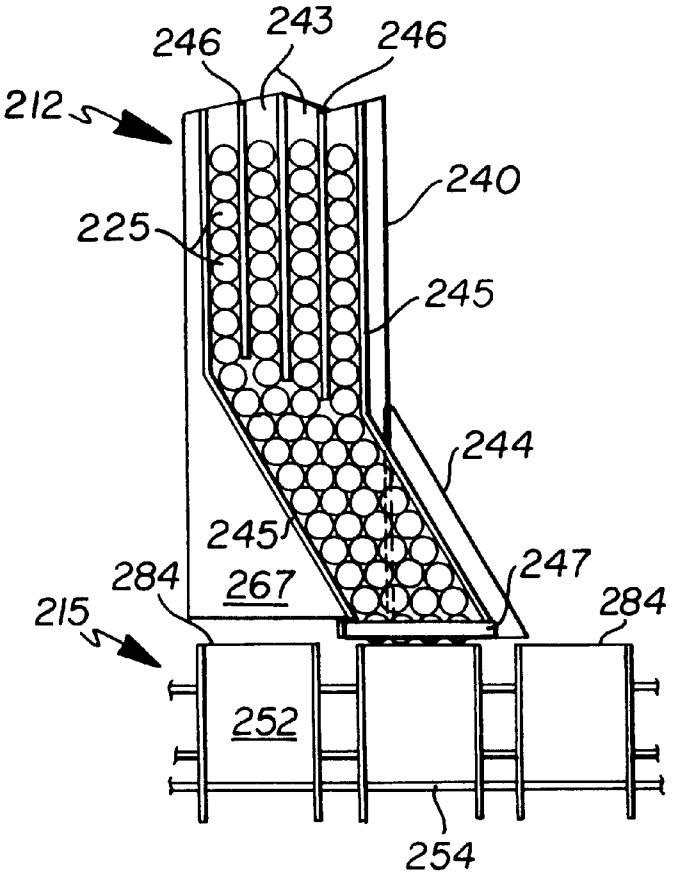
FIG. 9 is a plan view of another alternate embodiment of an article supply line.

Referring to FIG. 9, another alternate embodiment, also illustrated in FIG. 2, of the invention for a supply line 212 also has conveyor 240 oriented normal to the flow of the container line 215 and offset laterally from the front 284 of container 252. However, terminal end 267 of conveyor 240 is located very close to container 252, but not so close so as to drive articles held by overhead line stop 247. Deadplate 244 is generally triangular shaped and disposed to one side of conveyor 240 adjacent to container 252. Deadplate 244 supports all cans held by overhead line stop 247. As with the embodiment shown in FIG. 3, articles 225 transition from single lanes to closest packing configuration while still on conveyor 240. Part of the closest packing configuration of articles is supported by deadplate 244 and part is supported by conveyor 240. The part on conveyor 240 is driven directly by conveyor 240 and the part on deadplate 244 is driven by articles upstream on conveyor 240. Since all articles in the closest packing configuration are nested, driving only part of the configuration directly with conveyor 240 does not detrimentally affect the flow of articles from conveyor 240 across deadplate 244 into container 252.

Referring to FIGS. 8 and 9, lane divider walls 146 and 246 are thick enough to space lanes 143 and 243 sufficiently wide to keep each lane of articles aligned as articles change direction to nest in closest packing configuration. The width of lane divider walls 146 and 246 and staggering of their ends is such that articles 125 are transitioned from single lanes to closest packing configuration one row at a time. Outer walls 145 and 245 change direction as articles transition from single lanes to closest packing configuration.

An advantage of the apparatus and method of the present invention over previously known apparatus and methods is that the closest packing arrangement of cylindrical articles effectively locks articles together so that no article can move past other articles. This maintains the configuration of the group as articles flow into the container. The container fills smoothly and uniformly using pressure from the infeed conveyor. Lane separators are eliminated in the area where articles are staged to form a group. That eliminates problems caused by friction between articles and lane separators which would tend to let one lane of articles flow faster than another. Since articles are nested in a closest packing arrangement, they cannot flow past one another regardless of how much friction there may be on one side of the pack or the other against the outside walls.

Since lanes of articles cannot flow past one another to destroy the group configuration, it is not necessary to use individual lane stops or pack staging devices to lead articles into the container. Since infeed pressure is used to push articles into the container, no loading assembly is needed to accomplish that. Consequently, the infeed line stop can be an overhead device as simple as a bar extending across all the lanes of articles.

The apparatus and method of the present invention is usable to load cylindrical articles, such as beverage cans, into a variety of single level and two level or tier (stacked) pack combinations, typically from six to forty-eight cans per tier, into paperboard cartons or carriers. The apparatus and method are particularly well suited for processing relatively large groups of relatively small products as in the case of the stacked, forty-eight pack. Packaging is accomplished quickly and reliably, under typical industry tolerances for both beverage can and carton construction.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A method for packaging articles, comprising the steps of:

(a) supplying a stream of packaging units;

(b) supplying at least one input stream of cylindrical articles, the at least one input stream of articles comprising at least two lanes of cylindrical articles, the at least one stream of articles having a first portion wherein the lanes of articles are separated by at least one lane separator wall, a second portion wherein the lanes of articles are not separated by a lane separator wall, and a terminal end, the second portion forming a parallelogram-shaped, nested array of articles;

(c) redirecting the input stream of articles from the parallelogram-shaped, nested array of articles at the terminal end of the at least one input stream of articles into a rectangular array of articles;

(d) forming a flat, single layer article group at the terminal end of the at least one input stream of articles; and (e) loading the article group into a packaging unit in the stream of packaging units.

2. The method of claim 1, wherein a pair of input streams of articles is supplied, a second flat, single layer article group being formed and positioned on top of the first article group to form stacked article groups which are loaded into the packaging unit.

3. The method of claim 2, further comprising the step of depositing a divider sheet on top of the first article group prior to the second article group being positioned thereon, the second article group being slid across the divider sheet.

4. The method of claim 3, wherein the first article group is formed from a first stream of articles disposed at a first vertical level, and the second article group is formed from a second stream of articles disposed at a second vertical level above the first vertical level.

5. The method of claim 4, wherein the divider sheet is constructed of paperboard and has a thin, substantially flat, rectilinear configuration with a surface area substantially coextensive with that of a top surface of the first article group, wherein the articles are beverage cans, and wherein the packaging units are paperboard cartons with open ends bounded by flaps.

6. The method of claim 1, wherein the steps (c) and (d) are accomplished by providing a line of containers aligned with and adjacent to the packaging units and moving synchronously with the packaging units, the containers receiving articles from the at least one input stream of articles, the containers having side walls adapted for redirecting the input stream of articles from the parallelogram-shaped, nested array of articles at the terminal end of the at least one input stream of articles into the rectangular array of articles as articles flow into the containers, the side walls being spaced and the containers having a back stop which cooperates with the side walls to form the single layer group.

7. The method of claim 6, wherein step (d) further comprises the substeps of:

(d1) stopping flow of the articles into the container when the container is loaded;

(d2) moving the loaded container away; and (d3) moving another container into position to receive articles.

8. The method of claim 7, wherein substep (d1) further comprises the substep of:

(d1a) engaging a line stop device which constrains a row of articles adjacent to the loaded container after flow of the articles has stopped and before the loaded container is moved, the engaged line stop device thereby preventing flow of the articles after the loaded container is moved; and wherein substep (d3) further comprises the substep of:

(d3a) disengaging the line stop device after another container is in position to receive articles to thereby reestablish flow of the articles.

9. The method of claim 8, wherein substep (d1) further comprises the substep of:

(d1b) moving the back stop of a loaded container away from articles in the loaded container after the line stop device is engaged to allow a last row of articles in the loaded container to pass by articles constrained by the line stop device without scratching or otherwise damaging the articles.

10. The method of claim 6, wherein a pair of input streams of articles is supplied, a second flat, single layer article group being formed and positioned on top of the first article group to form a stacked article group in the container.

11. The method of claim 10, further comprising the step of depositing a divider sheet on top of the first article group prior to the second article group being positioned thereon, the second article group being slid across the divider sheet.

12. The method of claim 11, wherein the first article group is formed from a first stream of articles disposed at a first vertical level, and the second article group is formed from a second stream of articles disposed at a second vertical level above the first vertical level, each first article group being laterally moved into the container at a predetermined point and from a first lateral side of the line of containers, and each second article group being laterally moved onto the divider sheet at a second predetermined point and from the first lateral side of the line of containers.

13. An intermittent method of forming a stacked article group and loading it into a packaging unit, comprising the steps of:

(a) supplying a stream of packaging units;

(b) supplying low and high input streams of articles at an angle to the stream of packaging units, each of the input streams of articles comprising at least two lanes of cylindrical articles, each of the input streams of articles having a first portion wherein the lanes of articles are separated by at least one lane separator wall, a second portion wherein the lanes of articles are not separated by a lane separator wall, and a terminal end, the second portion being adapted for arranging the input streams of cylindrical articles into a parallelogram-shaped, nested array of articles;

(c) redirecting the parallelogram-shaped nested array of articles at the terminal end of each of the input streams of articles into rectangular array of articles;

(d) forming a low single layer article group at the terminal end of the low stream of articles by providing a line of containers aligned with and adjacent to the packaging units and moving parallel to and synchronously with the packaging units, the containers receiving articles from the low stream of articles, the containers having side walls adapted for redirecting the parallelogram-shaped, nested array of articles at the terminal end of the input streams of articles into the rectangular array of articles as articles flow into the containers, the side walls being spaced and the containers having a back stop which cooperates with the side walls to form the article groups;

(e) stopping flow of the articles into a container when the container is loaded;

(f) engaging a line stop device which constrains a row of articles adjacent to a loaded container after flow of the articles has stopped and before the loaded container is moved, the engaged line stop device thereby preventing flow of the articles after the loaded container is moved;

(g) moving the back stop of a loaded container away from articles in the loaded container after the line stop device is engaged to allow a last row of articles in the loaded container to pass by articles constrained by the line stop device without scratching or otherwise damaging the articles;

(h) moving the loaded container away;

(i) moving another container into position to receive articles;

(j) disengaging the line stop device after the empty container is in position to receive articles to thereby reestablish flow of the articles;

(k) placing a divider sheet on a top surface of the low article group after it is loaded into a container;

(l) repeating steps d–j for a high single layer article group at the terminal end of the high stream of articles wherein the high article group is loaded on top of the low article group in a container by sliding it over the divider sheet; and (m) substantially perpendicularly loading the stacked article group into a packaging unit on the packaging unit stream.

* * * * *